US009152105B2

(12) United States Patent
Kishi

(10) Patent No.: US 9,152,105 B2
(45) Date of Patent: Oct. 6, 2015

(54) FIXING DEVICE AND IMAGE FORMING APPARATUS INCORPORATING SAME

(71) Applicant: Kazuhito Kishi, Kanagawa (JP)

(72) Inventor: Kazuhito Kishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/168,357

(22) Filed: Jan. 30, 2014

(65) Prior Publication Data

US 2014/0226999 A1 Aug. 14, 2014

(30) Foreign Application Priority Data

Feb. 14, 2013 (JP) ..... 2013-026533
Dec. 20, 2013 (JP) ..... 2013-263681

(51) Int. Cl.
*G03G 15/20* (2006.01)

(52) U.S. Cl.
CPC ..... *G03G 15/2042* (2013.01); *G03G 15/2039* (2013.01)

(58) Field of Classification Search
CPC ..... G03G 15/2042; G03G 15/205
USPC ..... 399/70
See application file for complete search history.

(56) References Cited

U.S. PATENT DOCUMENTS

| | | | | |
|---|---|---|---|---|
| 5,151,719 | A * | 9/1992 | Akutsu et al. | 347/156 |
| 2010/0296828 | A1* | 11/2010 | Hara et al. | 399/69 |
| 2012/0213540 | A1* | 8/2012 | Igarashi | 399/69 |

FOREIGN PATENT DOCUMENTS

| | | | |
|---|---|---|---|
| JP | 2-143279 | | 6/1990 |
| JP | 6-095540 | | 4/1994 |
| JP | 2001-343860 | | 12/2001 |
| JP | 2001343860 | A * | 12/2001 |
| JP | 2004-109759 | | 4/2004 |
| JP | 2005-181946 | | 7/2005 |
| JP | 2008-112054 | | 5/2008 |
| JP | 2009-175679 | | 8/2009 |

OTHER PUBLICATIONS

U.S. Appl. No. 14/161,078, filed Jan. 22, 2014.
U.S. Appl. No. 14/173,171, filed Feb. 5, 2014.
U.S. Appl. No. 14/167,121, filed Jan. 29, 2014.
U.S. Appl. No. 14/174,134, filed Feb. 6, 2014.

* cited by examiner

*Primary Examiner* — Clayton E Laballe
*Assistant Examiner* — Leon W Rhodes, Jr.
(74) *Attorney, Agent, or Firm* — Oblon, McClelland, Maier & Neustadt, L.L.P.

(57) ABSTRACT

A fixing device includes a fixing member, a pressing member, a heating unit, multiple sub-heaters disposed in the heating unit, a temperature sensor to detect a temperature of the heating unit, and a heating control unit. The heating control unit controls the heating unit by controlling the multiple sub-heaters individually to heat the respective heating areas, such that a temperature at a portion of the fixing member corresponding to a blank area of the recording medium is lower than a temperature of a portion of the fixing member corresponding to an imaged area of the recording medium. The heating control unit further changes a size of a preliminary heating area to preliminarily heat the respective heating areas before the imaged area enters the fixing nip according to the temperature detected by the temperature sensor.

8 Claims, 9 Drawing Sheets

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2013-026533, filed on Feb. 14, 2013, and 2013-263681, filed on Dec. 20, 2013, in the Japan Patent Office, the entire disclosures of which are hereby incorporated by reference herein.

BACKGROUND

1. Technical Field

Embodiments of this disclosure generally relate to a fixing device employing a heating method and to an electrophotographic image forming apparatus, such as a copier, a printer, or a facsimile machine, incorporating the fixing device.

2. Related Art

Image forming apparatuses, such as copiers, facsimile machines, or printers usually form a toner image on an image carrier according to image data. The toner image is transferred from the image carrier onto a recording medium such as a sheet of paper or an overhead projector (OHP) sheet. The recording medium carrying the toner image is then conveyed to a fixing device, in which the toner image is fixed onto the recording medium under heat and pressure.

Fixing devices employing a heat-roller method usually include a fixing roller and a pressing roller. The fixing roller is heated by a heat source such as a halogen heater or an induction heating coil. The fixing roller and the pressing roller press against each other to form an area of contact herein called a nip, to which a recording medium carrying a toner image is conveyed. Toner included in the toner image is fused under heat and pressure in the nip. Thus, the toner image is fixed onto the recording medium. Such fixing devices are widely used for safety and adaptability to high-speed machines.

However, it takes a few minutes for the fixing roller, typically having a metal core and a large heat capacity, to reach a predetermined fixing temperature. Hence, the fixing roller is maintained at a predetermined temperature during standby time, resulting in relatively large energy consumption.

By contrast, fixing devices employing a belt or film method are frequently used for energy efficiency. Several energy-efficient fixing techniques employed with such fixing devices have been proposed, such as those externally heating a thermal insulating roller or selectively heating an imaged area according to the image data.

For example, JP-H06-095540-A discloses a fixing device employing the film method, in which a pressing roller and a planar heater that contact a thin, cylindrical film having thermal resistance sandwiches the film and a recording material so that the film and the recording material adhere to each other, thereby heating the recording material. Because the film has a thickness of only about 100 μm, in actuality the fixing device can be warmed up simply by increasing the temperature of the low heat-capacity planar heater. Accordingly, the warm-up time can be shortened and the preheating power can be reduced.

In addition, JP-H06-095540-A discloses a technique whereby the temperature of the heater and the heating areas are changed based on an image formed on the recording material to reduce energy supply to a blank area (i.e., a portion of an image formation area without an image), thereby enhancing energy efficiency.

JP-2005-181946-A discloses a technique whereby the temperature of a thermal heater is measured for each heating element to supply appropriate heat, thereby heating only a portion where toner exists on a surface of a sheet, taking into account the surrounding temperature.

JP-2001-343860 employs a fixing method to externally heat a roller. The external heating allows toner to be fused by heat accumulated on and around a fixing roller. Accordingly, such an external heating method realizes a shorter warm-up time and a higher energy efficiency than an internal heating method to heat an entire fixing roller. As in JP-H06-095540-A and JP-2005-181946-A, JP-2001-343860 discloses that imaged areas are selectively heated and that a second target temperature is provided which is lower than a target fixing temperature.

Typical fixing devices are supplied with a maximum energy sufficient to fix an image formed on an entire surface of a recording material.

However, when an imaged area is selectively heated, electric power is supplied before that imaged area enters the fixing nip. In other words, a preliminary heating area is provided, taking into account a predetermined time taken to warm up a heating member including a heat generator. The preliminary heating area is provided in a blank area that does not bear an unfixed toner image. Hence, the preliminary heating area is preferably as small as possible.

SUMMARY

This specification describes below an improved fixing device. In one embodiment of this disclosure, the fixing device fixes an unfixed image on a recording material in a fixing nip and including a rotatable fixing member to contact the unfixed image, a pressing member to contact the fixing member and form the fixing nip between the pressing member and the fixing member, a heating unit to heat the fixing member with electric power from a power source, multiple sub-heaters disposed in the heating unit to heat respective heating areas, arrayed in a direction perpendicular to a direction in which a recording material is conveyed, and a temperature sensor to detect a temperature of the heating unit. The fixing device further includes a heating control unit to control the heating unit by controlling the multiple sub-heaters individually to heat the respective heating areas, such that a temperature at a portion of the fixing member corresponding to a blank area of the recording medium is lower than a temperature of a portion of the fixing member corresponding to an imaged area of the recording medium. The heating control unit further changes a size of a preliminary heating area to preliminarily heat the respective heating areas before the imaged area enters the fixing nip according to the temperature detected by the temperature sensor.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
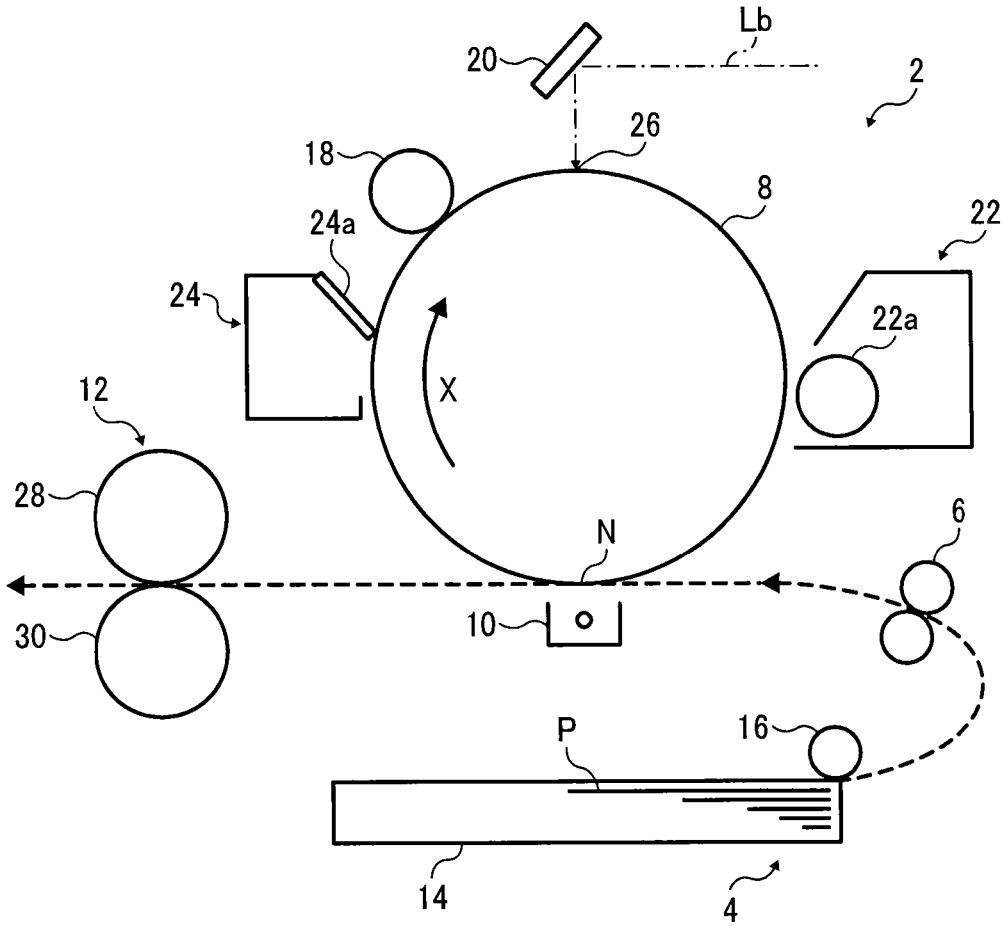
FIG. 1 is a schematic sectional view of an image forming apparatus according to embodiments.

The accompanying drawings are intended to depict embodiments of this disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and all of the components or elements described in the embodiments of this disclosure are not necessarily indispensable to the present invention.

In a later-described comparative example, embodiment, and exemplary variation, for the sake of simplicity like reference numerals will be given to identical or corresponding constituent elements such as parts and materials having the same functions, and redundant descriptions thereof will be omitted unless otherwise required.

Referring now to the drawings, wherein like reference numerals designate identical or corresponding parts throughout the several views, embodiments of this disclosure are described below.

Initially with reference to FIG. 1, a description is given of an image forming apparatus 2 according to embodiments of this disclosure.

FIG. 1 is a schematic sectional view of the image forming apparatus 2 according to embodiments of this disclosure.

As illustrated in FIG. 1, the image forming apparatus 2, herein serving as a printer, includes, e.g., a sheet-feeding unit 4, a pair of registration rollers 6, a photoconductive drum 8 serving as an image carrier, a transfer unit 10, and a fixing device 12.

The sheet-feeding unit 4 includes, e.g., a sheet tray 14 and a sheet-feeding roller 16. The sheet tray 14 accommodates a stack of sheets P serving as recording media. The sheet-feeding roller 16 sequentially separates and feeds an uppermost sheet P from the stack of sheets P accommodated in the sheet tray 14. The pair of registration rollers 6 temporarily stops the uppermost sheet P fed by the sheet-feeding roller 16 to correct the position of the sheet P. The sheet P is then conveyed to a transfer nip N from the pair of registration rollers 6 in synchronization with rotation of the photoconductive drum 8, that is, in a manner such that a leading end of a toner image formed on the photoconductive drum 8 meets a predetermined portion at a leading end of the sheet P in a direction in which the sheet P is conveyed.

The photoconductive drum 8 is surrounded by various pieces of imaging equipment disposed in a direction indicated by arrow X. Specific examples of such imaging equipment include, but are not limited to, a charging roller 18 serving as a charging unit, a mirror 20 included in an exposure unit, a development unit 22 including a development roller 22*a*, a transfer unit 10, and a cleaning unit 24 including a cleaning blade 24*a*. A laser beam Lb is directed onto an exposure part 26 on the photoconductive drum 8 via the mirror 20, between the charging roller 18 and the development unit 22, and an outer surface of the photoconductive drum 8 at the exposure part 26 is scanned.

A description is now given of operation of the image forming apparatus 2. The image forming apparatus 2 performs imaging operation in the same manner as typical image forming apparatuses. When the photoconductive drum 8 starts to rotate, the charging roller 18 uniformly charges the outer surface of the photoconductive drum 8. The light beam Lb is directed and scanned to the exposure part 26 according to image data to form an electrostatic latent image corresponding to a target image.

The rotation of the photoconductive drum 8 moves the electrostatic latent image to the development unit 22. The development unit 22 develops the electrostatic latent image by supplying toner to the electrostatic latent image to form a visible image, also known as a toner image. The toner image thus formed on the photoconductive drum 8 is transferred onto the sheet P, which enters the transfer nip N in a predetermined timing, with a transfer bias applied by the transfer unit 10. The sheet P carrying the toner image is conveyed toward the fixing device 12. The fixing device 12 fixes the toner image onto the sheet P. The sheet P is then outputted to an output tray, in which multiple sheets P are stacked one atop another.

Residual toner remaining on the photoconductive drum 8 after a transfer process conducted at the transfer nip N reaches the cleaning unit 24 by the rotation of the photoconductive drum 8. The residual toner on the photoconductive drum 8 is scraped off, and thus removed by the cleaning blade 24*a* while passing through the cleaning unit 24. A neutralizing unit then removes residual charge on the photoconductive drum 8, thereby preparing for a next imaging process.

Figure 2:
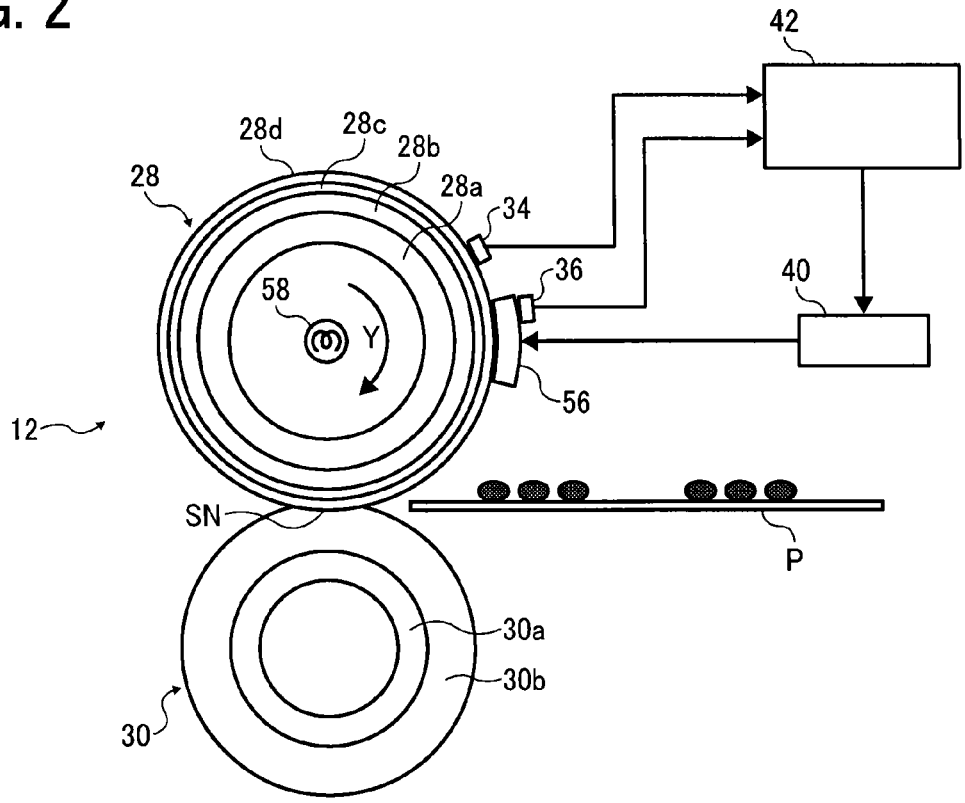
FIG. 2 is a schematic sectional view of a fixing device according to a first embodiment.
Figure 3:
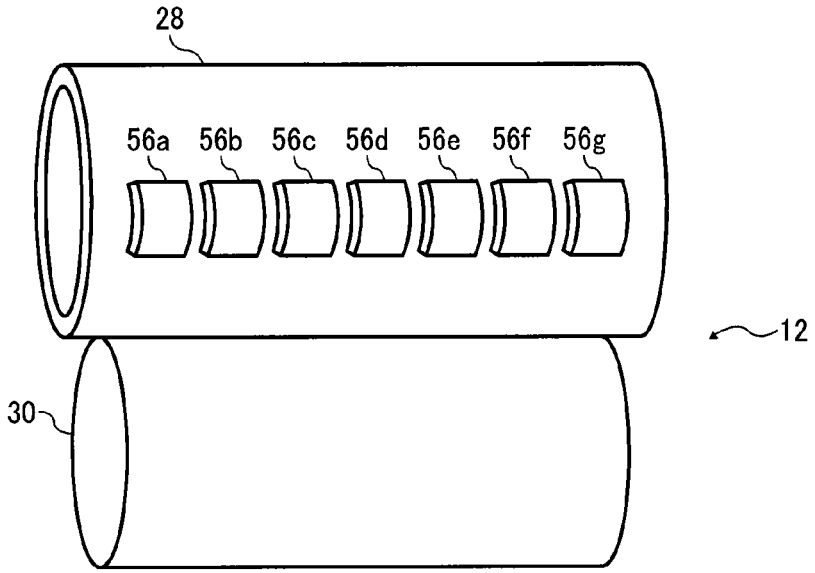
FIG. 3 is a partial perspective view of the fixing device of FIG. 2.

Referring now to FIGS. 2 and 3, a description is now given of a fixing device 12 according to a first embodiment, which employs an external heating method.

FIG. 2 is a schematic sectional view of the fixing device 12 according to the first embodiment.

The fixing device 12 includes, e.g., a fixing roller 28, a pressing roller 30, and a heater 56. The fixing roller 28 serves as a fixing member to rotate while contacting an unfixed image. The pressing roller 30 serves as a pressing member to form a fixing nip SN between the pressing roller 30 and the fixing roller 28. The heater 56 serves as a heating unit to heat the fixing roller 28 with electric power supplied from a commercial power source 40. The heater 56 may be, e.g., a thermal heater or ceramic heater, including a planar base and a heating element disposed on the planar base. The heater 56 herein serves as an external heating unit supplied with the electric power from the power source 40.

As illustrated in FIG. 3, the heater 56 includes multiple sub-heaters, which, in the present embodiment, are seven sub-heaters 56*a* through 56*g*, arrayed at a predetermined interval in a width direction of a sheet P. The sub-heaters 56*a* through 56*g* are configured to separately heat respective heating areas.

Referring back to FIG. 2, thermistors 34 and 36, the power source 40, and an external heating control unit 42 are disposed downstream from the fixing nip SN and upstream from the heater 56 in a direction indicated by an arrow Y, in which the fixing roller 28 rotates. The thermistor 34 serves as a temperature sensor to detect a surface temperature of the fixing roller 28. The thermistor 36 serves as a temperature sensor to detect a temperature of the heater 56. The power source 40 supplies electric power to the heater 56. The external heating control unit 42 controls the power source 40 according to detection data of the thermistors 34 and 36.

The external heating control unit 42 is herein constituted as a microprocessor including, e.g., a central processing unit (CPU), a read-only memory (ROM), a random-access memory (RAM), and an input/output (I/O) interface.

The fixing roller 28 is constructed of a metal core 28*a*, a heat insulation layer 28*b*, a heat conductive layer 28*c*, and a release layer 28*d*.

The metal core 28*a* is made of aluminum and has an outer diameter of about 50 mm and a thickness of about 3 mm.

The heat insulation layer 28*b* coats an outer surface of the metal core 28*a*. The heat insulation layer 28*b* is made of silicone rubber and has a thickness of about 4 mm. The heat insulation layer 28*b* may be made of foam silicone rubber to prevent heat diffusion and enhance heat insulation.

The heat conductive layer 28*c* is made of nickel and formed on the heat insulation layer 28*b*. Alternatively, the heat conductive layer 28*c* may be made of another material as long as the heat conductive layer 28*c* has a higher heat conductivity than at least the heat insulation layer 28*b*. For example, the heat conductive layer 28*c* may be made of an iron alloy such as stainless steel, or metal such as aluminum or copper. Alternatively, the heat conductive layer 28*c* may be a graphite sheet.

The heat conductive layer 28*c* reduces localized unevenness in surface temperature of the fixing roller 28 caused by uneven heating by the heater 56. Rapid heat transmission between adjacent sub-heaters 56*a* through 56*g* where heat is not generated reduces fixing failures of images.

Moreover, the heat conductive layer 28*c* has an effect to increase the temperature of a slightly wider area than an area heated by the heater 56, thereby compensating a slight shift from an image. In other words, sizes of and intervals between the sub-heaters 56*a* through and 56*g* of the heater 56 can be set relatively in a wide range.

The release layer 28*d* is formed on an outer surface of the heat conductive layer 28*c* to enhance the durability and maintain the releasing performance. The release layer 28*d* is made of fluorine resin such as perfluoroalkoxy (PFA) or polytetrafluoroethylene (PTFE), and has a thickness of about 20 μm to about 80 μm.

The pressing roller 30 is constructed of a metal core 30*a* and an elastic layer 30*b*. The metal core 30*a* is made of iron and has an outer diameter of about 50 mm and a thickness of about 4 mm. The elastic layer 30*b* coats an outer surface of the metal core 30*a*. The elastic layer 30*b* is made of silicone rubber and has a thickness of about 5 mm. To enhance releasing performance, a fluorine resin layer having a thickness of about 50 μm may be formed on a surface of the elastic layer 30*b*.

The pressing roller 30 is pressed against the fixing roller 28 by a biasing unit. The heater 56 is pressed against a surface of the fixing roller 28 by a biasing unit.

As described later, control of the sub-heaters 56*a* through 56*g* according to the image data can enhance energy efficiency.

If the surface temperature of the fixing roller 28 is hard to be increased to a predetermined fixing temperature because of low heating efficiency of the heater 56, a halogen heater 58 disposed in the fixing roller 28 may be used to heat the fixing roller 28 so that the fixing roller 28 reaches a temperature slightly lower than the fixing temperature. Then, the heater 56 may be used to heat and increase the temperature of the fixing roller 28 at a portion corresponding to an imaged area. Accordingly, overall energy consumption can be reduced.

If an image is formed across an entire image formation area on the sheet P, the entire fixing roller 28 is heated, obviating heating control according to the image data. Hence, the fixing roller 28 may be heated up to a fixing temperature only by the halogen heater 58. Alternatively, the halogen heater 58 and the heater 56 may be simultaneously energized during a warm-up time only, to further shorten the warm-up time.

Referring now to FIGS. 4A, 4B, 5A, and 5B, a description is now given of the heating control, in which the external heating control unit 42 controls the heater 56 according to the image data to form an image on the sheet P.

Figure 4A:
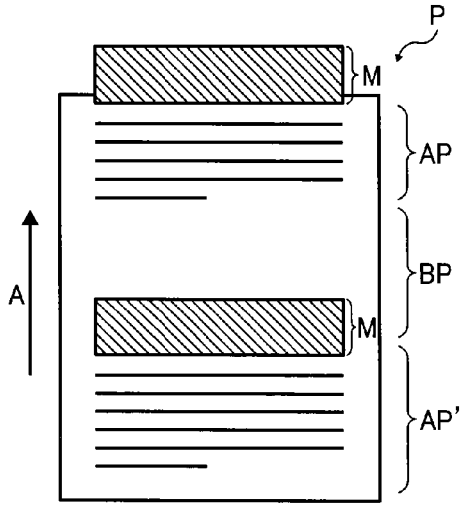
FIG. 4A is a plan view of a sheet, illustrating imaged areas and a blank area of the sheet.
Figure 4B:
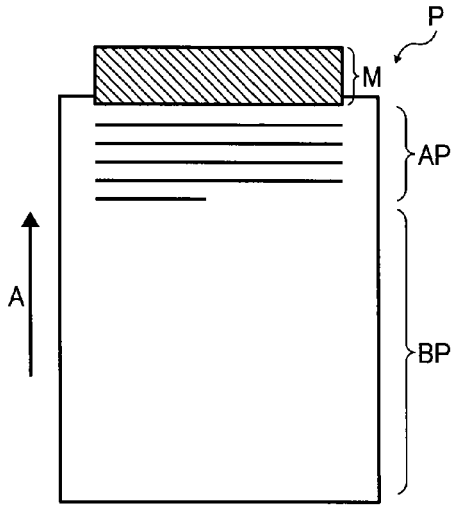
FIG. 4B is a plan view of a sheet, illustrating an imaged area and a blank area of the sheet.

FIGS. 4A and 4B are plan views of sheets P, illustrating imaged areas and blank areas of the sheets P.

FIG. 4A illustrates an image formation pattern including an imaged area AP, a blank area BP, and an imaged area AP' in this order from a leading end of the sheet P in a direction indicated by arrow A (hereinafter referred to as direction A) in which the sheet P is conveyed. The imaged areas AP and AP' include toner to be fixed while the blank area BP does not include toner to be fixed.

FIG. 4B illustrates another image formation pattern including an imaged area AP and a blank area BP in this order from a leading end of the sheet P in the direction A. The imaged area AP includes toner to be fixed while the blank area BP does not include toner to be fixed.

Figure 5A:
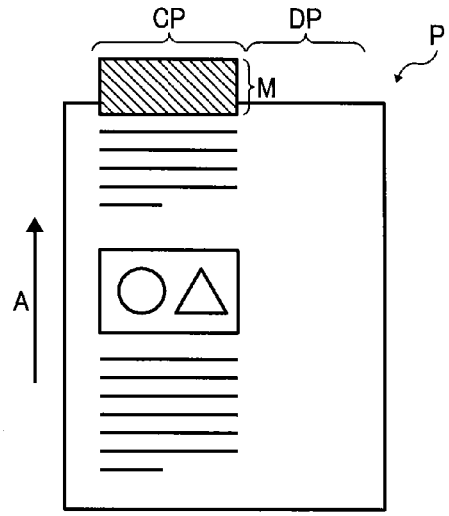
FIG. 5A is a plan view of a sheet, illustrating an imaged area and a blank area of the sheet.
Figure 5B:
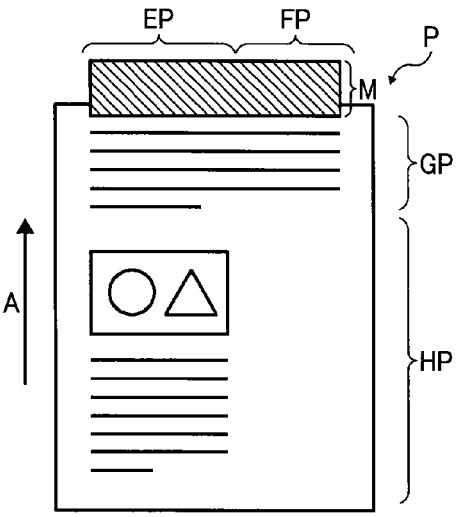
FIG. 5B is a plan view of a sheet, illustrating imaged areas and a blank area of the sheet.

FIGS. 5A and 5B are plan views of sheets P illustrating imaged areas and blank areas of the sheets P.

FIG. 5A illustrates an image formation pattern including an imaged area CP, and a blank area DP in a direction perpendicular to the direction A, that is, in a longitudinal direction of the fixing roller 28. The imaged area CP includes toner to be fixed while the blank area DP does not include toner to be fixed.

FIG. 5B illustrates another image formation pattern including imaged areas EP and FP in the direction perpendicular to the direction A, and an imaged area GP and a blank area HP in this order from a leading end of the sheet P in the direction A. The imaged areas EP, FP, and GP include toner to be fixed while the blank area HP does not include toner to be fixed.

Referring back to FIG. 4A, when image data of the image formation pattern is inputted to the external heating control unit 42 from an image processing device, the external heating control unit 42 controls the power source 40 and the heater 56 such that a portion of the fixing roller 28 corresponding to the blank area BP has a lower temperature than portions of the fixing roller 28 corresponding to the imaged areas AP and AP'.

It is to be noted that a portion of the fixing roller 28 corresponding to an imaged area or a blank area is a portion of the fixing roller 28 that adheres to the imaged area or the blank area. In other words, electric power is supplied to all the sub-heaters 56*a* through 56*g* so that the portion of the fixing roller 28 corresponding to the imaged area AP, which is distributed over an entire width of the sheet P, obtains a predetermined fixing temperature. Then, the electric power is reduced to heat the portion of the fixing roller 28 corresponding to the blank area BP. Thereafter, the electric power is supplied again to the sub-heaters 56*a* through 56*g* so that the portion of the fixing roller 28 corresponding to the imaged area AP', which is located at a rear end of the sheet P, reaches the fixing temperature.

Referring to FIG. 4B, as in FIG. 4A, the electric power is supplied to all the sub-heaters 56*a* through 56*g* so that the portion of the fixing roller 28 corresponding to the imaged area AP obtains the predetermined fixing temperature. Then, the electric power is reduced to heat the portion of the fixing roller 28 corresponding to the blank area BP.

Referring to FIG. 5A, the electric power is supplied to the sub-heaters 56*a* through 56*g* such that a portion of the fixing roller 28 corresponding to the imaged area CP, which is distributed over half a width of the sheet P, obtains the predetermined fixing temperature. Specifically, the external heating control unit 42 controls the power source 40 to supply a lower electric power to, e.g., the sub-heaters 56*e* through 56*g* than to the sub-heaters 56*a* through 56*d* such that a portion of the fixing roller 28 corresponding to the blank area DP has a lower temperature than the portion of the fixing roller 28 corresponding to the imaged area CP.

Referring to FIG. 5B, the electric power is supplied to all the sub-heaters 56*a* through 56*g* such that a portion of the fixing roller 28 corresponding to the imaged area GP, which is distributed over an entire width of the sheet P, obtains the predetermined fixing temperature. Thereafter, a larger electric power is supplied to, e.g., the sub-heaters 56*a* through 56*d* than to the sub-heaters 56*e* through 56*g* such that a portion of the fixing roller 28 corresponding to the imaged area EP, which is distributed over half the width of the sheet P, obtains the predetermined fixing temperature.

It is to be noted that the electric power is supplied to the heater 56 to heat a portion of the fixing roller 28 corresponding to a preliminary heating area M, which is illustrated with hatching in each of FIGS. 4A, 4B, 5A, and 5B. The preliminary heating area M allows the sub-heaters 56*a* through 56*d* to preliminarily heat their respective heating areas. The electric power is supplied to the heater 56 before an imaged area (e.g., imaged area AP) enters the fixing nip SN. The preliminary heating area M is provided taking into account the length of the heater 56 in a circumferential direction thereof and the time taken to warm up the heater 56. The preliminary heating area M is preferably provided as small as possible for the energy efficiency.

Heating control may be performed to completely stop power supply to the heater 56 so that the heater 56 does not heat the portions of the fixing roller 28 corresponding to the blank areas BP, DP, and HP. In such a case, however, the temperature of the fixing roller 28 might excessively decrease to affect a subsequent rise to a fixing temperature to heat a subsequent imaged area (e.g., imaged area AP' of FIG. 4A). Hence, the heater 56 is stuttered or supplied with a low electric power to maintain the fixing roller 28 at a predetermined temperature or higher.

Thus, a lower electric power is supplied to the heater 56 to heat the portions of the fixing roller 28 corresponding to the blank areas BP, DP, and HP, thereby enhancing the energy efficiency.

According to the first embodiment, the heater 56 contacts and heats the surface of the fixing roller 28. Alternatively, the external heating control unit 42 may include an excitation coil and inverter to inductively heat the fixing roller 28 without contacting the fixing roller 28. In such a case, the excitation coil may be prepared by, e.g., winding a Litz wire from 5 times to 15 times. The Litz wire includes about 50 to about 500 conductive wire strands, individually insulated and twisted together. Each conductive wire has a diameter of about 0.05 mm to about 0.2 mm. Such an induction heating method can control the temperature of the fixing roller 28 according to the image data. Accordingly, a fixing device 12 employing the induction heating method can enhance the energy efficiency as in the fixing device 12 according to the first embodiment.

Figure 6:
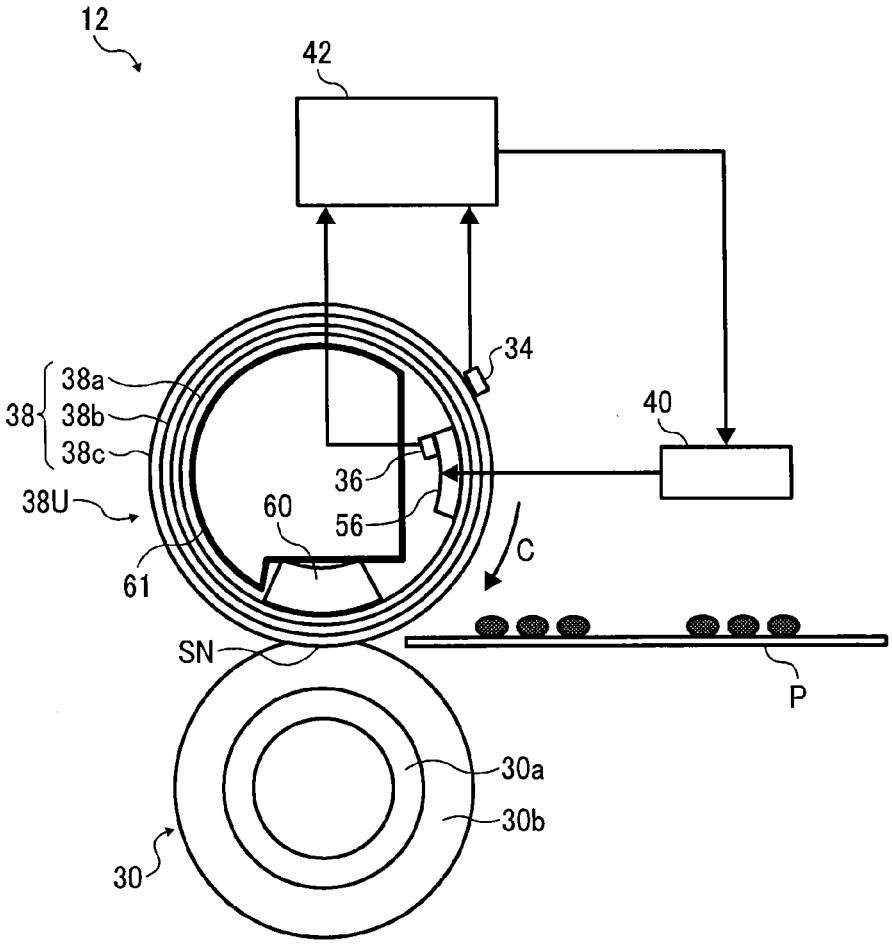
FIG. 6 is a schematic sectional view of a fixing device according to a second embodiment.
Figure 7:
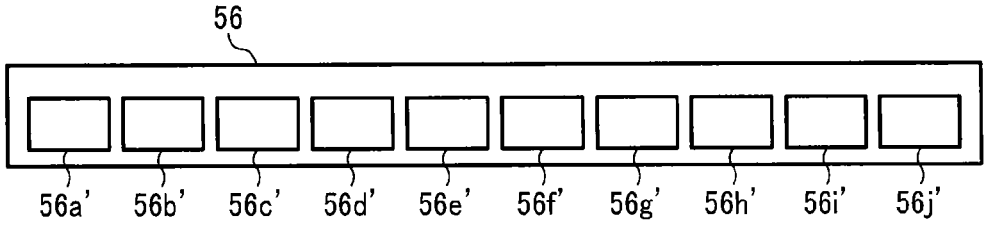
FIG. 7 is a schematic view of a heater including ten sub-heaters.

Referring now to FIGS. 6 and 7, a description is given of a fixing device 12 according to a second embodiment.

FIG. 6 is a schematic sectional view of the fixing device 12 according to the second embodiment.

In the fixing device 12 according to the second embodiment, a heater 56 is disposed inside a loop formed by a fixing belt (or film) 38 to increase the temperature of the fixing belt 38, thereby heating and fixing an unfixed image formed on a sheet P conveyed at a fixing nip SN.

The heater 56 is disposed upstream from the fixing nip SN in a direction indicated by arrow C (hereinafter referred to as direction C) in which the fixing belt 38 rotates, because it takes time for the heat from the heater 56 disposed inside the loop formed by the fixing belt 38 to reach an outer surface of the fixing belt 38. Alternatively, the heater 56 may be disposed near the fixing nip SN. A fixing device employing an external heating method, such as the fixing device 12 according to the first embodiment, may also have the heater 56 near the fixing nip SN.

As illustrated in FIG. 7, the heater 56 serving as a planar heating unit has multiple sub-heaters, which, in the present embodiment, are ten sub-heaters 56*a*' through 56*j*' arrayed in a direction perpendicular to a direction in which the sheet P is conveyed. The sub-heaters 56*a*' through 56*j*' are separately controlled to heat their respective heating areas.

Referring back to FIG. 6, the fixing belt 38 serving as a fixing member is constructed of a base 38*a*, an elastic layer 38*b*, and a release layer 38*c*. The base 38*a* is made of stainless steel and has an outer diameter of about 50 mm and a thickness of about 40 μm. Alternatively, the base 38*a* may be polyimide to enhance durability and maintain releasing performance. The elastic layer 38*b* coats an outer surface of the base 38*a*. The elastic layer 38*b* is made of silicone rubber and has a thickness of about 100 μm. The release layer 38*c* is formed on the elastic layer 38*b* to enhance durability and maintain releasing performance. The release layer 38*c* is made of fluorine resin such as PFA or PTFE, and has a thickness of about 20 μm to 80 μm.

A support member 61 and a nip forming member 60 serving as a pressure member and facing the fixing nip SN are also disposed inside the loop formed by the fixing belt 38 to support the fixing belt 38 in connection with an external member.

The fixing belt 38 and the components disposed inside the loop formed by the fixing belt 38, that is, a thermistor 36, the heater 56, the pressure member 60, and the support member 61, may constitute a belt unit 38U separably coupled with the pressing roller 30.

Figure 8:
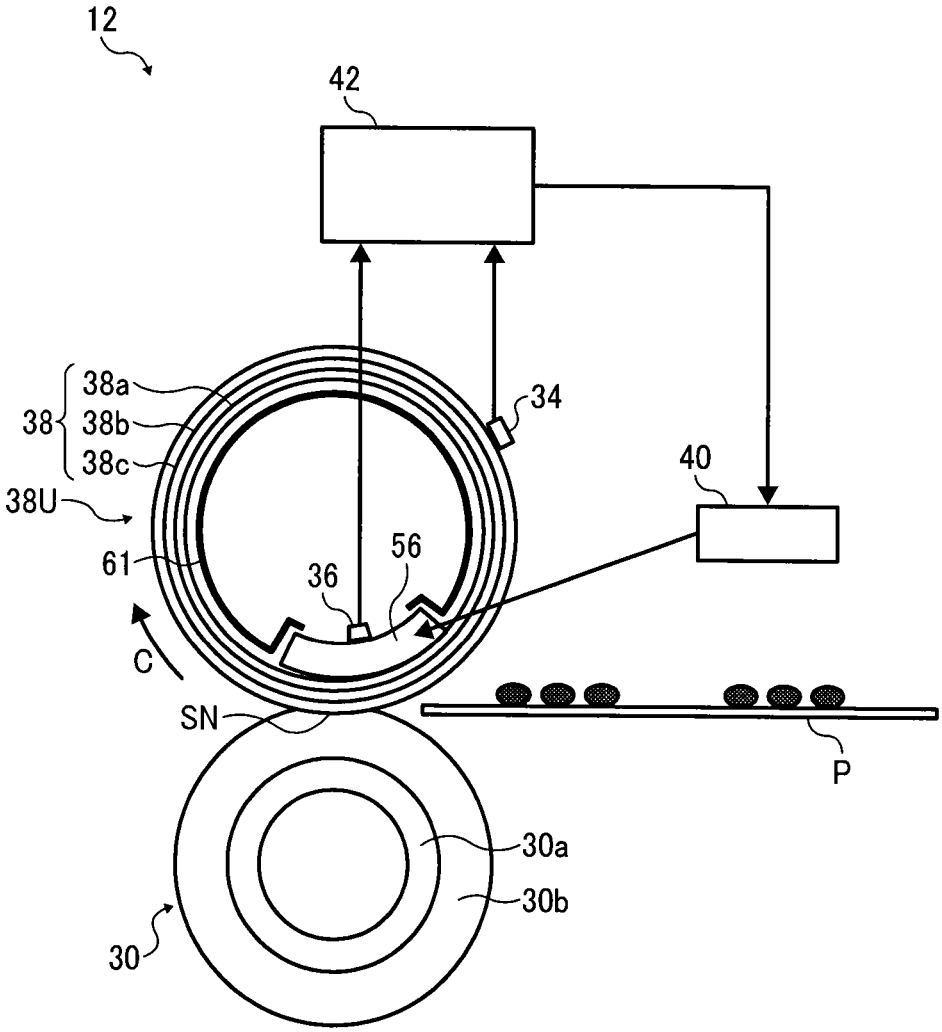
FIG. 8 is a schematic sectional view of a fixing device according to a third embodiment.

Referring now to FIG. 8, a description is given of a fixing device 12 according to a third embodiment.

FIG. 8 is a schematic sectional view of the fixing device 12 according to the third embodiment.

As illustrated in FIG. 8, a heater 56 serving as a planar heating unit is disposed facing a fixing nip SN, thereby also serving as a pressure member. A configuration of the fixing device 12 according to the third embodiment is otherwise the same as the fixing device 12 of FIG. 6 according to the second embodiment.

It is to be noted that the fixing belt 38 illustrated in FIG. 6 may be configured to be heated by the external heating method as illustrated in FIG. 2.

The fixing belt 38 and the components disposed inside a loop formed by the fixing belt 38, that is, a thermistor 36, the heater 56, and a support member 61, may constitute a belt unit 38U separably coupled with the pressing roller 30.

Figure 9:
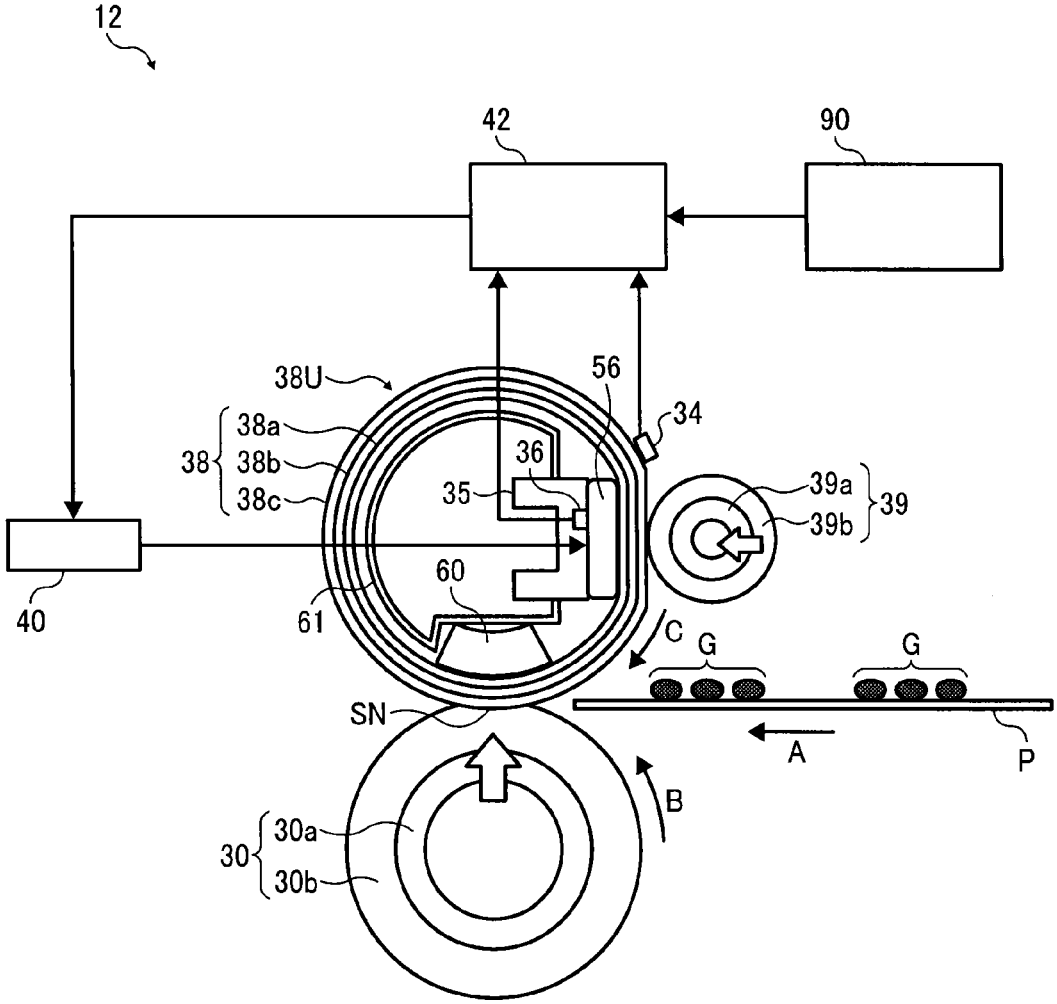
FIG. 9 is a schematic sectional view of a fixing device according to a fourth embodiment.

Referring now to FIG. 9, a description is given of a fixing device 12 according to a fourth embodiment.

FIG. 9 is a schematic sectional view of the fixing device 12 according to the fourth embodiment.

As illustrated in FIG. 9, the fixing device 12 includes a fixing belt 38 serving as a fixing rotation body, a pressing roller 30 serving as a facing member (or facing rotation body) to contact the fixing belt 38 to form a fixing nip SN, and a heater 56 serving as a heating member to heat a fixing belt 38. The heater 56 contacts the fixing belt 38 in a substantially flat manner. A separate pressure roller 39, described in detail below, is disposed facing the heater 56 outside the fixing belt 38, at a location other than that of the pressing roller 30.

The fixing belt 38 is a thin, endless belt member having flexibility. The belt member is not limited to a belt. The belt member may be, e.g., a film. Specifically, the fixing belt 38 is constructed of a base 38*a*, an elastic layer 38*b*, and a release layer 38*c*. The base 38*a* is made of stainless steel and has an outer diameter of about 40 mm and a thickness of about 40 μm. Alternatively, the base 38*a* may be made of a resin material such as polyimide. The elastic layer 38*b* is made of silicone rubber and has a thickness of about 100 μm. The release layer 38*c* is made of fluorine resin such as PFA or PTFE, and has a thickness of about 5 μm to 50 μm. The elastic layer 38*b* coats an outer circumferential surface of the base 38*a*. The release layer 38*c* coats an outer circumferential surface of the elastic layer 38*b*.

The pressing roller 30 is constructed of a metal core 30*a* and an elastic layer 30*b*. The metal core 30*a* is made of iron and has an outer diameter of about 40 mm and a thickness of about 2 mm. The elastic layer 30*b* coats an outer circumferential surface of the metal core 30*a*. The elastic layer 30*b* is made of silicone rubber and has a thickness of about 5 mm. To enhance releasing performance, a release layer made of fluorine resin having a thickness of about 40 μm may be formed on an outer circumferential surface of the elastic layer 30*b*.

A nip forming member 60 serving as a pressure member is disposed facing the pressing roller 30 inside a loop formed by the fixing belt 38. Both ends of the nip forming member 60 are supported by side plates of the fixing device 12. The pressing roller 30 is pressed against the nip forming member 60 by a pressing unit such as a pressure lever, thereby forming the fixing nip SN having a predetermined width in which the fixing belt 38 and the pressing roller 30 is in pressure contact with each other. Alternatively, the fixing belt 38 serving as a fixing rotation body and the pressing roller 30 serving as a facing member may be in contact with each other without pressure.

The pressing roller 30 is configured to be driven by a driving source such as a motor to rotate in a direction indicated by arrow B (hereinafter referred to as direction B) in FIG. 9. The driving force generated by the rotation of the pressing roller 30 is transmitted to the fixing belt 38 through the fixing nip SN, thereby rotating the fixing belt 38 in a direction C in FIG. 9. A belt support member 61 is disposed inside the loop formed by the fixing belt 38 to support the fixing belt 38.

The heater 56 is a sheet or planar heat generator such as a thermal heater or a ceramic heater. A stay 35 serving as a support member is disposed inside the loop formed by the fixing belt 38. The stay 35 supports the heater 56 such that the heater 56 faces an inner circumferential surface of the fixing belt 38, on an upstream side from the fixing nip SN in a direction A in which a sheet P is conveyed. A power source 40 is connected to the heater 56 to supply electric power to the heater 56. An external heating control unit 42 controls an output from the power source 40. The external heating control unit 42 is constituted as a microprocessor including, e.g., a CPU, a ROM, a RAM, and an I/O interface.

The fixing device 12 includes a first thermistor 36 and a second thermistor 34. The first thermistor 36 serves as a heater temperature sensor to detect a temperature of the heater 56. The second thermistor 34 serves as a belt temperature sensor to detect a temperature of the fixing belt 38. The first thermistor 36 is disposed so as to directly contact the heater 56. The second thermistor 34 is disposed so as to face an outer circumferential surface of the fixing belt 38, upstream from the heater 56 in the direction C in which the fixing belt 38 rotates. Temperature data obtained by the first thermistor 36 and the second thermistor 34 is inputted to the external heating control unit 42. The external heating control unit 42 is configured to control an output from the power source 40 according to the temperature data thus inputted.

An image processing unit 90 illustrated in FIG. 9 receives an image signal transmitted by an image reader or an external device of the image forming apparatus 2 to perform a predetermined imaging process. Then, the external heating control unit 42 receives image data from the image processing unit 90. The external heating control unit 42 controls an output of the heater 56 via the power source 40 according to the image data.

A pressure roller 39 is disposed facing the heater 56 outside the fixing belt 38. The pressure roller 39 serves as a pressure member to apply pressure to the fixing belt 38. The pressure roller 39 applies pressure to the outer circumferential surface of the fixing belt 38 toward the heater 56 disposed inside the loop formed by the fixing belt 38 so that the fixing belt 38 contacts the heater 56. The pressure roller 39 has an outer diameter of about 15 mm to about 30 mm. The pressure roller 39 is constructed of a metal core 39*a* and an elastic layer 39*b*. The metal core 39*a* is made of iron and has an outer diameter of about 8 mm. The elastic layer 39*b* coats an outer circumferential surface of the metal core 39*a*. The elastic layer 39*b* is made of silicone rubber and has a thickness of about 3.5 mm to about 11 mm. To enhance releasing performance, a release layer made of fluorine resin having a thickness of about 40 μm may be formed on an outer circumferential surface of the elastic layer 39*b*. The pressure roller 39 is herein pressed against the fixing belt 38 by a pressing unit. Alternatively, the pressing unit may be omitted so that the pressure roller 39 contacts the fixing belt 38 without pressure.

The fixing belt 38 and the components disposed inside the loop formed by the fixing belt 38, that is, the stay 35, the thermistor 36, the heater 56, the nip forming member 60, and the support member 61, may constitute a belt unit 38U separably coupled with the pressing roller 30.

Referring to FIG. 9, a description is now given of basic operation of the fixing device 12.

When the image forming apparatus 2 is activated, the power source 40 starts to supply electric power to the heater 56 while the pressing roller 30 starts to rotate in the direction B. The rotation of the pressing roller 30 drives the fixing belt 38 to rotate in the direction C due to frictional force therebetween.

Thereafter, when the sheet P carrying an unfixed toner image G is conveyed to the fixing nip SN formed between the fixing belt 38 and the pressing roller 30 after the foregoing imaging process, the toner image G formed on the sheet P is fixed onto the sheet P under heat and pressure in the fixing nip SN. The sheet P is then outputted from the fixing nip SN, and consequently from the image forming apparatus 2.

As described above, the energy efficiency can be enhanced by controlling the temperature of a fixing member (e.g., fixing roller 28), particularly by decreasing the temperature of portions of the fixing member corresponding to the preliminary heating area M and a blank area according to data obtained by associated imaging equipment. In addition, such control can prevent typical problems arising from the foregoing types of fixing devices, such as a decrease in durability of the fixing member and a pressing member (e.g., pressing roller 30) and an adverse thermal effect on surrounding components caused by an excessive temperature increase at a portion of the fixing member corresponding to a blank area.

According to the foregoing embodiments, the energy efficiency is enhanced by reducing a power supply to the heater 56 to heat a portion of the fixing member corresponding to a blank area. As described above, a preliminary heating area M is provided in a blank area (e.g., blank area BP of FIG. 1) followed by an imaged area (e.g., imaged area AP' of FIG. 1) to allow sub-heaters (e.g., 56*a* through 56*g*) to preliminarily heat their respective heating areas before the imaged area enters a fixing nip SN. Accordingly, the energy efficiency is preferably enhanced by downsizing the preliminary heating area M.

Figure 10:
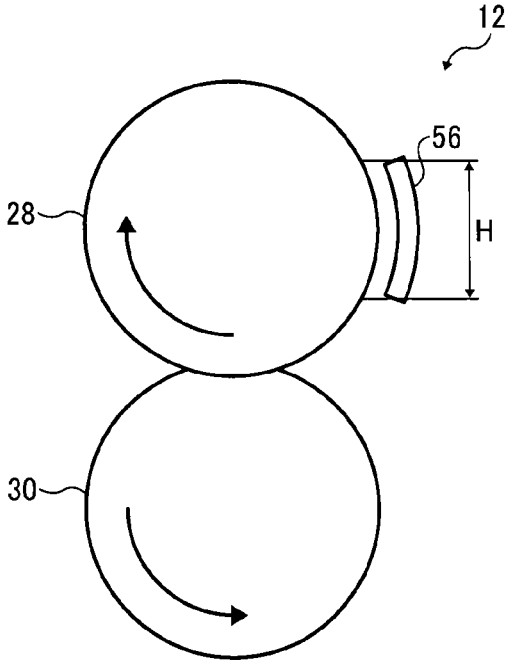
FIG. 10 is a schematic view of a fixing device employing an external heating method.
Figure 11:
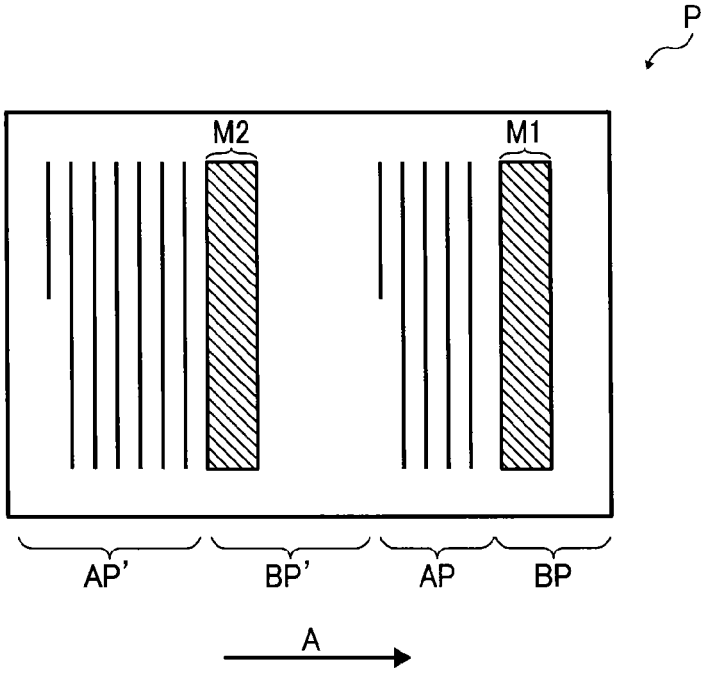
FIG. 11 is a plan view of a sheet, illustrating imaged areas, blank areas, and preliminary heating areas of the sheet.
Figure 12:
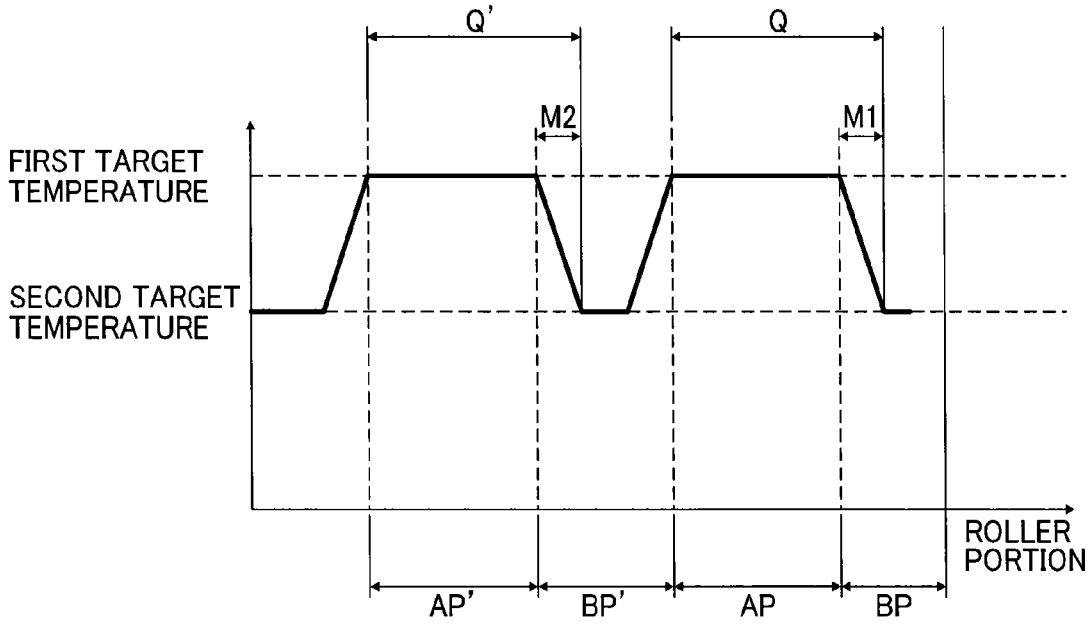
FIG. 12 is a graph of a relationship between target temperatures and roller portions.

Referring now to FIGS. 10 through 12, a detailed description is given of the preliminary heating area M.

FIG. 10 is a schematic sectional view of a fixing device 12 employing an external heating method.

The fixing device 12 includes, e.g., a fixing roller 28 serving as a fixing member, a pressing roller 30, and a heater 56 serving as an external heating unit. Alternatively, the fixing device 12 may have a configuration as illustrated in FIG. 6, in which a fixing belt serving as a fixing member is heated from within.

FIG. 11 is a plan view of a sheet P, illustrating an image formation pattern including a blank area BP, an imaged area AP, a blank area BP', and an imaged area AP' in this order from a leading end of the sheet P in a direction A in which the sheet P is conveyed.

Preliminary heating areas M1 and M2 are provided in the blank areas BP and BP', respectively.

FIG. 12 is a graph of a relationship between target temperatures and portions of the fixing roller 28.

A horizontal axis indicates surface portions of the fixing roller 28. A vertical axis indicates target control temperatures at the portions of the fixing roller 28. Portions AP and AP' correspond to the imaged areas AP and AP' of FIG. 11. Portions BP and BP' correspond to the blank areas BP and BP' of FIG. 11. As illustrated in FIG. 12, a first target temperature is maintained for the imaged areas AP and AP'. A second target temperature is maintained for the blank areas BP and BP'. The second target temperature is lower than the first target temperature and higher than a room temperature.

Portions Q and Q' indicate heated portions of the fixing roller 28. The portion Q includes the portion A and a portion corresponding to a preliminary heating area M1. In other words, a relation of Q=A+M1 is satisfied. The portion Q' includes the portion A' and a portion corresponding to a preliminary heating area M2. In other words, a relation of Q'=A'+M2 is satisfied. In the light of a width H of the heater 56 illustrated in FIG. 10 and a warm-up time for the heater 56, the preliminary heating areas M1 and M2 are provided to allow the portions AP and AP', respectively, to have a sufficiently increased surface temperature.

The following describes some examples of the preliminary heating area M applied to the fixing devices 12 according to the foregoing embodiments.

Figure 13:
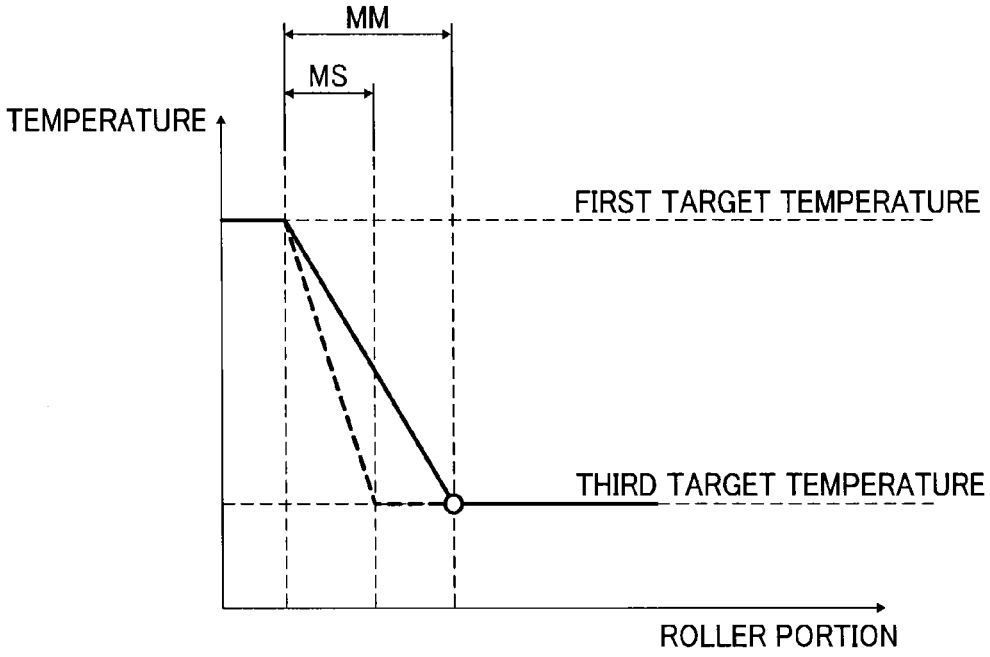
FIG. 13 is a graph of a relationship between target temperatures and roller portions, particularly illustrating the relationship between the target temperatures and the roller portions corresponding to preliminary heating areas.

Referring now to FIG. 13, a description is given of a preliminary heating area M according to a first example to enhance the energy efficiency.

FIG. 13 is a graph of a relationship between target temperatures and portions of a fixing member (e.g., fixing belt 38), particularly illustrating the relationship between the target temperatures and the portions of the fixing member corresponding to preliminary heating areas MM and MS.

According to the first example, when an image (e.g., image illustrated in FIG. 11) is fixed on a sheet P, an external heating control unit 42 changes the size of the preliminary heating area M according to detected data of a fixing device 12 incorporating the external heating control unit 42. In FIG. 13, a temperature change in a portion of the fixing member corresponding to a preliminary heating area MM is indicated by a solid line. A temperature change in a portion of the fixing member corresponding to a preliminary heating area MS is indicated by a broken line. For example, the preliminary heating area MM is provided in an initial state upon activation of an image forming apparatus 2. In such a state, the fixing member has a third target temperature that is close to a room temperature or lower than a fixing temperature. The preliminary heating area MM has a sufficient size to increase the temperature of the fixing member to a first target temperature.

It is to be noted that the preliminary heating area M is set to a predetermined size before an imaged area enters a fixing nip SN. If the preliminary heating area M is set to a size smaller than the predetermined size, the fixing member might not reach the first target temperature when the imaged area enters the fixing nip SN, causing fixing failures.

Specifically, the external heating control unit 42 appropriately sets the size of the preliminary heating area M according to the temperature of a contact heater 56 detected by a thermistor 36. As indicated by the solid line in FIG. 13, the preliminary heating area MM, herein defined as a reference preliminary heating area, is provided to allow the fixing member to sufficiently heat the imaged area when the heater 56 has a low temperature, particularly, in the initial state of the image forming apparatus 2. Whereas, when the temperature of the fixing member increases faster than an initial setting, the preliminary heating area MS is provided for heating control of the heater 56, as indicated by the broken line in FIG. 13. The preliminary heating area MS is smaller than the preliminary heating area MM. For example, the preliminary heating area MS is provided when the heater 56 has a higher temperature than a predetermined temperature due to a continuous printing operation. Accordingly, the energy efficiency can be enhanced when the heater 56 maintains a sufficient temperature to heat an imaged area. For example, the energy efficiency can be enhanced when multiple sheets P continuously pass through the fixing nip SN.

To heat the preliminary heating area MM, an electric power of, e.g., 200 W·s (100 watts×2 seconds) is supplied to the heater 56. Whereas, to heat the preliminary heating area MS, an electric power of, e.g., 100 W·s (100 watts×1 second) is supplied to the heater 56. Thus, the energy efficiency can be enhanced by shortening the duration of power supply while image forming operation is reliably performed. It is to be noted that the first target temperature is e.g., 120° C., the second target temperature is e.g., 90° C., and the third target temperature is e.g., 80° C. or a room temperature.

In the foregoing descriptions with reference to FIGS. 11 through 13, an image is uniformly formed in an axial direction of a roller (e.g., fixing roller 28), i.e., in a direction perpendicular to the direction A in which the sheet P is conveyed. Alternatively, the image may be divided into multiple imaged areas in the axial direction. In such a case, different preliminary heating areas M may be provided to the imaged areas based on detected temperatures of sub-heaters of the heater 56.

If the detected temperatures of the sub-heaters of the heater 56 are lower than a predetermined temperature, the external heating control unit 42 may set a preliminary heating area M to be larger than the preliminary heating area MM to obtain a reliable image fixability.

Figure 14:
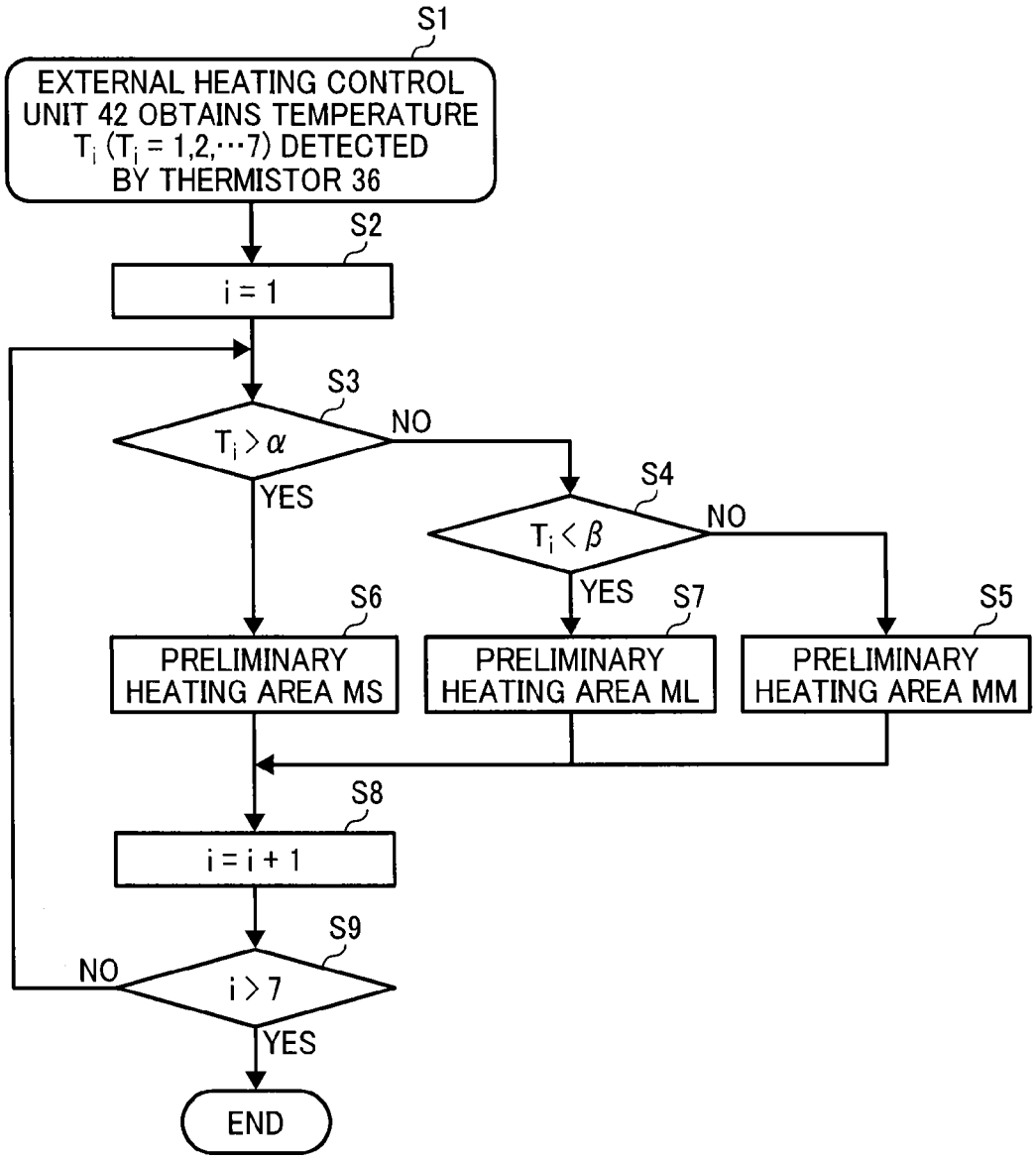
FIG. 14 is a flowchart of a process for setting a preliminary heating area according to detection results of the sub-heaters.

FIG. 14 is a flowchart of a process for setting the preliminary heating area M according to detection results of the sub-heaters 56*a* through 56*g*.

Sub-heaters $\mathbf{56}_i$ (i=1 to 7) correspond to the sub-heaters 56*a* through 56*g*. At first, the reference preliminary heating area MM is set for all the sub-heaters $\mathbf{56}_1$ through $\mathbf{56}_7$. The thermistor 36 detects a temperature $T_i$ (i=1 to 7) of each sub-heater $\mathbf{56}_i$ in a predetermined timing.

Thereafter, the external heating control unit 42 obtains $T_i$ (i=1 to 7) (S1). Then, the external heating control unit 42 firstly determines a temperature $T_i$ of the sub-heater $\mathbf{56}_i$ where i=1 (S2). If the temperature $T_1$ is equal to or lower than a threshold α (No in S3) and equal to or higher than a threshold β (No in S4), the external heating control unit 42 maintains the preset preliminary heating area MM (S5). In such a case, the difference between the temperature $T_1$ and the threshold α is small enough to obviate changes from the reference preliminary heating area MM. If the temperature $T_1$ exceeds the threshold α (Yes in S3), the external heating control unit 42 sets the preliminary heating area MS that is smaller than the reference preliminary heating area MM (S6), because the sub-heater $\mathbf{56}_1$ has a temperature higher than a predetermined temperature. If the temperature $T_1$ is lower than the threshold β (Yes in S4), the external heating control unit 42 sets a preliminary heating area ML that is larger than the reference preliminary heating area MM (S7), because the sub-heater $\mathbf{56}_1$ has a temperature lower than the predetermined temperature. It is to be noted that a relation of α>β is satisfied. Then, the external heating control unit 42 determines a temperature $T_i$ of the sub-heater $\mathbf{56}_i$ where i=2 (S8, S9, and back to S3). The foregoing steps S3 to S9 are repeated to set target temperatures of each sub-heater $\mathbf{56}_i$ (i=1 to 7) to heat portions of the fixing member corresponding to an imaged area and a blank area.

The temperatures of all the sub-heaters 56*a* through 56*g* are herein detected. Alternatively, a temperature of one of the sub-heaters 56*a* through 56*g* may be selectively detected to set the preliminary heating area M.

A description is now given of a preliminary heating area M according to a second example to enhance the energy efficiency. The external heating control unit 42 sets the size of the preliminary heating area M according to the voltage of a commercial power source 40 detected by a sensor. Specifically, the external heating control unit 42 sets the preliminary heating area M to be smaller than the preliminary heating area MM when the detected voltage is high. The voltage is detected, e.g., when an image forming apparatus 2 is activated. In addition, the voltage may be detected per second except during an imaging process. Such control is particularly effective when an alternating-current (AC) voltage is directly applied to a heater 56 serving as a heating element from the power source 40. For example, such a smaller preliminary heating area M is provided when the voltage increases from 100 V to 110 V, i.e., about 120% of electric power is supplied.

Thus, the energy efficiency can be enhanced, e.g., when devices disposed around the image forming apparatus 2 are deactivated and the power source 40 is in a good condition.

Whereas, if the voltage of the power source 40 is low, a larger preliminary heating area M is provided to obtain a reliable image fixability.

According to the first example, a smaller preliminary heating area (i.e., preliminary heating area MS) is provided when the thermistor 36 detects a higher temperature than a predetermined temperature. According to the second example, the external heating control unit 42 has multiple threshold temperatures to change the size of the preliminary heating area M, and correlatively changes the size of the preliminary heating area M according to the temperature detected by the thermistor 36. Accordingly, the fixing device 12 can perform reliable heating operation under wider operational conditions, thereby enhancing the energy efficiency and obtaining high image quality.

This disclosure has been described above with reference to specific exemplary embodiments. It is to be noted that this disclosure is not limited to the details of the embodiments described above, but various modifications and enhancements are possible without departing from the spirit and scope of the invention. It is therefore to be understood that this disclosure may be practiced otherwise than as specifically described herein. For example, elements and/or features of different illustrative exemplary embodiments may be combined with each other and/or substituted for each other within the scope of this invention. The number of constituent elements and their locations, shapes, and so forth are not limited to any of the structure for performing the methodology illustrated in the drawings.

What is claimed is:

1. A fixing device to fix an unfixed image on a recording material in a fixing nip, the fixing device comprising:

a rotatable fixing member to contact the unfixed image;

a pressing member to contact the fixing member and form the fixing nip between the pressing member and the fixing member;

a heater to heat the fixing member with electric power from a power source;

multiple sub-heaters disposed in the heater to heat respective heating areas, arrayed in a direction perpendicular to a direction in which a recording material is conveyed;

a temperature sensor to detect a temperature of the heater; and a heating controller to control the heater by controlling the multiple sub-heaters individually to heat the respective heating areas, such that a temperature at a portion of the fixing member corresponding to a blank area of the recording medium is lower than a temperature of a portion of the fixing member corresponding to an imaged area of the recording medium, the heating controller further changing a size of a preliminary heating area by changing a duration of a preliminary heating to preliminarily heat the respective heating areas before the imaged area enters the fixing nip according to the temperature detected by the temperature sensor.

2. The fixing device according to claim 1, wherein the heater is a heating element configured to contact the fixing member to increase a temperature of the fixing member, and the heating controller sets the preliminary heating area to be smaller than a reference preliminary heating area when the temperature sensor detects a temperature of the heater higher than a predetermined temperature.

3. The fixing device according to claim 2, wherein the heating controller sets the preliminary heating area to be equal to or larger than a reference preliminary heating area when the temperature sensor detects a temperature of the heater not higher than the predetermined temperature.

4. The fixing device according to claim 1, wherein the heating controller sets the preliminary heating area to be smaller than a reference preliminary heating area when a voltage of the power source exceeds a predetermined voltage.

5. The fixing device according to claim 1, wherein the heating controller has multiple threshold temperatures for changing the size of the preliminary heating area according to the temperature detected by the temperature sensor.

6. An image forming apparatus comprising the fixing device according to claim 1.

7. A fixing device to fix an unfixed image on a recording material in a fixing nip, the fixing device comprising:

a rotatable fixing member to contact the unfixed image;

a pressing member to contact the fixing member and form the fixing nip between the pressing member and the fixing member;

a heater to heat the fixing member with electric power from a power source;

multiple sub-heaters disposed in the heater to heat respective heating areas, arrayed in a direction perpendicular to a direction in which a recording material is conveyed;

a temperature sensor to detect a temperature of the heater; and a heating controller to control the heater by controlling the multiple sub-heaters individually to heat the respective heating areas, such that a temperature at a portion of the fixing member corresponding to a blank area of the recording medium is lower than a temperature of a portion of the fixing member corresponding to an imaged area of the recording medium, the heating controller further changing a size of a preliminary heating area to preliminarily heat the respective heating areas before the imaged area enters the fixing nip according to the temperature detected by the temperature sensor, wherein the heating controller sets the preliminary heating area to be smaller than a reference preliminary heating area when a voltage of the power source exceeds a predetermined voltage.

8. A fixing device to fix an unfixed image on a recording material in a fixing nip, the fixing device comprising:

a rotatable fixing member to contact the unfixed image;

a pressing member to contact the fixing member and form the fixing nip between the pressing member and the fixing member;

a heater to heat the fixing member with electric power from a power source;

multiple sub-heaters disposed in the heater to heat respective heating areas, arrayed in a direction perpendicular to a direction in which a recording material is conveyed;

a temperature sensor to detect a temperature of the heater; and a heating controller to control the heater by controlling the multiple sub-heaters individually to heat the respective heating areas, such that a temperature at a portion of the fixing member corresponding to a blank area of the recording medium is lower than a temperature of a portion of the fixing member corresponding to an imaged area of the recording medium, the heating controller further changing a size of a preliminary heating area to preliminarily heat the respective heating areas before the imaged area enters the fixing nip according to the temperature detected by the temperature sensor, wherein the heating controller has multiple threshold temperatures for changing the size of the preliminary heating area according to the temperature detected by the temperature sensor.

* * * * *